US009227778B2

(12) United States Patent
Aviles et al.

(10) Patent No.: US 9,227,778 B2
(45) Date of Patent: Jan. 5, 2016

(54) BEVERAGE CARTRIDGE

(71) Applicants: Victor M. Aviles, East Sandwich, MA (US); Carlos Alvarez, Old Bridge, NJ (US)

(72) Inventors: Victor M. Aviles, East Sandwich, MA (US); Carlos Alvarez, Old Bridge, NJ (US)

( * ) Notice: Subject to any disclaimer, the term of this patent is extended or adjusted under 35 U.S.C. 154(b) by 203 days.

(21) Appl. No.: 13/711,360

(22) Filed: Dec. 11, 2012

(65) Prior Publication Data

US 2014/0161940 A1 Jun. 12, 2014

(51) Int. Cl.
*B65D 85/804* (2006.01)
*B65D 81/32* (2006.01)

(52) U.S. Cl.
CPC ..... *B65D 85/8043* (2013.01); *B65D 81/3233* (2013.01); *B65D 81/3238* (2013.01)

(58) Field of Classification Search
CPC ..... B65D 3/0061; B65D 85/8043; A47J 31/0068; A47J 31/24; A47J 31/3666; A47J 31/3676; A47J 31/3695; A47J 31/407
USPC ..... 426/77, 78, 79, 80, 81, 82, 83, 84; 99/295
See application file for complete search history.

(56) References Cited

U.S. PATENT DOCUMENTS 4,886,674 A * 12/1989 Seward et al. ..... 426/79
5,840,189 A 11/1998 Sylvan et al.
6,358,545 B1 * 3/2002 Chandler et al. ..... 426/79
8,062,682 B2 * 11/2011 Mandralis ..... B65D 85/8043 206/219
2005/0051478 A1 3/2005 Karanikos et al.
2005/0266122 A1 12/2005 Franceschi
2006/0065127 A1 3/2006 Dalton et al.
2007/0196402 A1 8/2007 De La Mettrie et al.
2009/0007796 A1 1/2009 Ricotti
2010/0252496 A1 * 10/2010 Freiheit et al. ..... 210/489
2011/0244108 A1 10/2011 Rabin
2012/0058226 A1 * 3/2012 Winkler et al. ..... 426/79
2012/0308688 A1 12/2012 Peterson et al.

FOREIGN PATENT DOCUMENTS

EP 2030915 3/2009

* cited by examiner

*Primary Examiner* — Rena L Dye
*Assistant Examiner* — Ericson M Lachica
(74) *Attorney, Agent, or Firm* — Leason Ellis LLP

(57) ABSTRACT

A beverage cartridge is provided for use in forming a beverage in a beverage machine that provides a pressurized liquid. The cartridge includes a container having an interior space; a rim; a lid attached to the rim and closing the opening of the container, wherein the lid accommodates an inflow of the pressurized liquid; a membrane disposed within the interior space and defining a first chamber and a second chamber within the interior space, wherein the membrane is configured to selectively isolate the first and second chamber; a fluid stored within the second chamber wherein the fluid is arranged to interact with the pressurized liquid introduced into the container to form the beverage; and a filter disposed within the first chamber, wherein the filter is arranged to contain a first beverage medium arranged to interact with the pressurized liquid introduced into the container to form the beverage.

20 Claims, 4 Drawing Sheets

BEVERAGE CARTRIDGE

TECHNICAL FIELD OF THE INVENTION

This invention relates to a beverage cartridge to be used with a beverage forming system, such as a single-serve coffee maker.

BACKGROUND OF THE INVENTION

Cartridges for use with beverage forming machines are well known, and can include one or more filters as well as a beverage medium, such as ground coffee beans, tea leaves, etc. In some cartridges, the filter is located between two or more portions of an interior space of the cartridge, e.g., one portion in which a beverage medium is located, and a second portion into which liquid that has passed through the permeable filter can flow. An example of one such cartridge is disclosed in U.S. Pat. No. 5,840,189 and/or U.S. Pat. No. 6,607,762, which can be used with a beverage making machine like that described in U.S. Pat. No. 7,398,726. (U.S. Pat. Nos. 5,840,189; 6,607,762; and 7,398,726, which are hereby incorporated by reference in their respective entireties.) In use, the beverage forming machine introduces a pressurized fluid into the cartridge to interact with the beverage medium. In some machines, a piercing outlet needle of the machine is used to pierce a surface of the cartridge (e.g., a bottom wall of the cartridge container or the cartridge lid) permitting the pressurized liquid that has interacted with the beverage medium to flow through the filter and exit the cartridge.

Known cartridges are limited in that they are configured to contain one or more dry beverage mediums. These cartridges incorporate a permeable filter and as such are incapable of containing ingredients that are suitable to create a beverage that requires both a dry beverage medium and a liquid beverage medium. For example, known cartridges are incapable of producing an "Irish Coffee" in which the ingredients are coffee and Irish whiskey and are formed by running water through dry coffee grounds and adding Irish whiskey. Because known cartridges are configured to use permeable filters between two or more portions of an interior space of the cartridge, e.g., one portion in which a dry beverage medium is located, and a second portion into which pressurized liquid that has passed through the permeable filter can flow, containing a liquid, such as alcohol, etc., in the second portion of the cartridge would permeate the filter and quickly spoil the beverage medium.

Accordingly it is desirable to provide a beverage cartridge that can contain dry beverage mediums and a liquid without mixing the multiple beverage mediums substantially prior to forming a beverage.

SUMMARY OF THE INVENTION

According to a first aspect, a beverage cartridge is provided for use in forming a beverage in a beverage machine that provides a pressurized liquid. The cartridge includes a container having an exterior surface and an interior space; a rim attached to the container and defining an opening to the interior space; a lid attached to the rim and closing the opening of the container, wherein the lid is pierceable by the beverage machine to accommodate an inflow of the pressurized liquid into the interior space to form the beverage; a membrane disposed within the interior space and defining a first chamber and a second chamber within the interior space, wherein the membrane is configured to selectively isolate the first and second chamber; a fluid stored within the second chamber wherein the fluid is arranged to interact with the pressurized liquid introduced into the container to form the beverage; and a filter disposed within the first chamber, wherein the filter is arranged to contain a first beverage medium arranged to interact with the pressurized liquid introduced into the container to form the beverage.

According to another aspect, a cartridge for use in forming a beverage in a beverage machine that provides a pressurized liquid is provided. The cartridge includes a container having an exterior surface and an interior space; a rim attached to the container and defining an opening to the interior space; a lid attached to the rim and closing the opening of the container; a membrane disposed within the interior space and defining a first chamber and a second chamber within the interior space, wherein the membrane is configured to selectively isolate the first and second chamber; a fluid stored within the second chamber; and a filter disposed within the first chamber, wherein the filter is arranged to contain a first beverage medium.

These and other aspects of the invention will be apparent from the following description and claims.

BRIEF DESCRIPTION OF DRAWINGS

Aspects of the invention are described below with reference to the following drawings in which like numerals reference like elements, and wherein.

DETAILED DESCRIPTION OF CERTAIN EMBODIMENTS OF THE INVENTION

It should be understood that aspects of the invention are described herein with reference to the figures, which show illustrative embodiments. The illustrative embodiments described herein are not necessarily intended to show all embodiments in accordance with the invention, but rather are used to describe a few illustrative embodiments. Thus, aspects of the invention are not intended to be construed narrowly in view of the illustrative embodiments. In addition, it should be understood that aspects of the invention can be used alone or in any suitable combination with other aspects of the invention.

Figure 2:
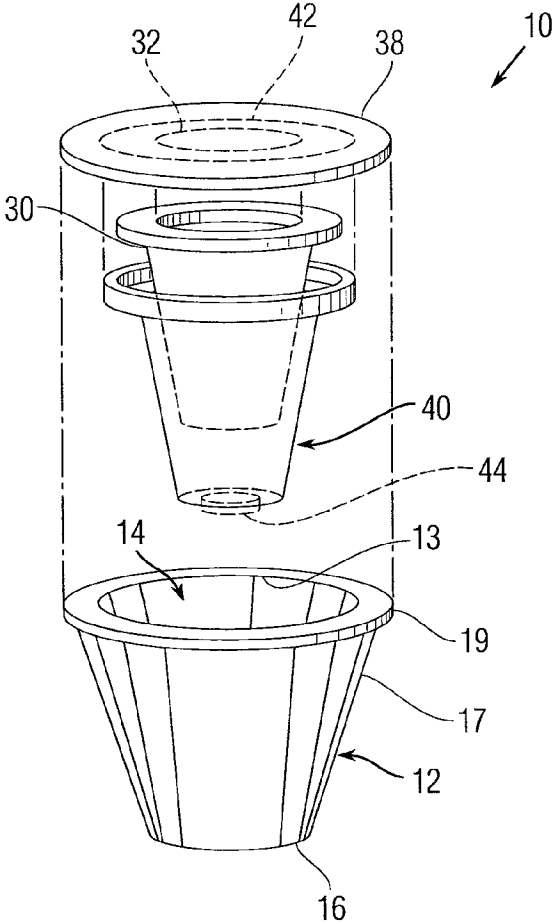
FIG. 2 is an exploded perspective view of the cartridge of FIG. 1.
Figure 1:
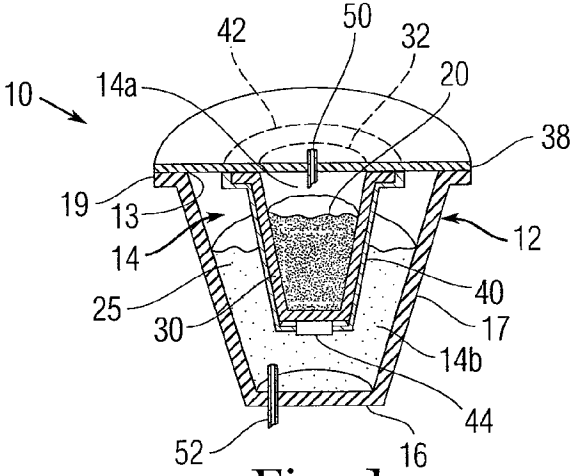
FIG. 1 is a side cross-sectional view of a cartridge in accordance with aspects of the invention.

FIGS. 1 and 2 show a side cross-sectional view and an exploded perspective view, respectively, of an illustrative cartridge 10 that incorporates one or more aspects of the invention. The cartridge 10 can be used in a beverage machine to form any suitable beverage such as tea, coffee, other infusion-type beverages formed from a dry beverage medium, a fluid ingredient and a liquid, such as pressurized, chilled, carbonated, and/or heated water.

Thus, the cartridge 10 can contain any suitable first beverage medium 20, e.g., ground coffee, tea leaves, dry herbal tea, powdered beverage concentrate and/or other dry beverage-making material (such as powdered milk or other creamers, sweeteners, thickeners, flavorings, and so on). In accordance with a salient aspect of the invention, the cartridge can also contain a fluid 25, e.g. an alcoholic ingredient, dairy product, liquid flavoring and the like. In one illustrative embodiment, the cartridge 10 contains a beverage medium 20 and fluid 25 that are configured for use with a machine that forms coffee and/or tea beverages, however, aspects of the invention are not limited in this respect. In this illustrative embodiment, the cartridge 10 includes a container 12 that includes an interior space 14 having a first chamber 14*a* and a second chamber 14*b* that are separated by a membrane 40. The membrane is configured to selectively isolate the first chamber and second chamber such that the contents of the first and second chambers are isolated when stored, but are not isolated when the cartridge is used to form a beverage. A filter 30 is disposed within the first chamber and is configured to contain the first beverage medium 20. The fluid 25 is stored within the second chamber.

It should be understood, however, that other additional chambers in the interior space and/or sub-portions or areas of the first and second chambers, can be provided in other embodiments. For example, it is possible for the cartridge to have three spaces that are separated by two membranes (e.g., a first membrane separates the first and second chambers and a second membrane separates two portions of the second chamber), and so on. Similarly, the first and/or second chambers can be divided or otherwise separated into two or more portions or areas by filters, walls, dividers, passageways, and other features.

In this embodiment, the container 12 can have a frustoconical cup shape with a sidewall 17 and an opening 13. However, in other embodiments, the container 12 can have a fluted, conical, or cylindrical shape, can be in the form of a square or rectangular cup, a domed cup, a sphere or partial sphere, or other suitable form, can have a fluted, corrugated, or otherwise shaped sidewall, and so on. Also, the container 12 need not necessarily have a defined shape, as is the case with some beverage sachets and pods. For example, although the container 12 in this embodiment has a relatively rigid and/or resilient construction so that the container 12 tends to maintain its shape, the container 12 could be made to have a more compliant and/or deformable arrangement, e.g., like a sachet container made from a sheet of deformable material.

If the container 12 includes an opening 13, the opening 13 can be closed by a lid 38, e.g., a foil and polymer laminate material that is attached to a rim 19 of the container 12. (Although in this embodiment the rim 19 is arranged as an annular flange-like element, the rim 19 can be arranged in other ways. For example, the rim 19 can be the top edge of the sidewall 17 without any flange element.) The container 12 and/or the lid 38 can provide a barrier to moisture and/or gases, such as oxygen. For example, the container 12 can be made of a polymer laminate, e.g., formed from a sheet including a layer of polystyrene or polypropylene and a layer of EVOH and/or other barrier material, such as a metallic foil. Such an arrangement can provide suitable protection for the first beverage medium 20, e.g., from unwanted exposure from moisture, oxygen and/or other materials. It should be understood, however, that the container 12 and/or the lid 38 can be made of other materials or combinations of materials, such as biopolymers, compostable polymers, paper, foils, etc.

In accordance with an aspect of the invention, the membrane 40 can be attached to the lid 38 at a periphery 42 that is spaced inwardly and away from the rim 19. In addition, the membrane 40 can extend from the periphery 42 at least partially into the interior space 14. As mentioned above, the membrane 40 is arranged to separate the first chamber 14*a* from the second chamber 14*b*.

In this illustrative embodiment, the membrane 40 can have a substantially frustoconical shape, as shown. However, the membrane 40 can have any suitable shape, such as a cylindrical shape, a square cup shape, a domed shape, a flat sheet, or other. The membrane 40 can be the attached to the lid 38, or in addition or alternatively to the container 12, in any suitable way, such as by an adhesive, thermal welding, ultrasonic welding, chemical bonding, crimping or other mechanical bonding, etc. As will be understood, the shape of the periphery 42 can depend on the shape of the membrane, at least at an upper end of the membrane 42. In this embodiment, the periphery 42 has a circular shape, but oval, rectangular, triangular, irregular and other shapes are possible. In this illustrative embodiment, the membrane 40 can be constructed from a fluid non-permeable material including polypropylene and cellulose material, a polymer laminate, e.g., formed from a sheet including a layer of polystyrene or polypropylene and a layer of EVOH and/or other barrier material and can be attached to the lid 38 at an upper portion of the membrane 40 by thermal welding. As can be seen in FIGS. 1-2, the upper portion of the membrane 40 that is attached to the lid 38 can have an annular, or washer-like shape that extends radially outwardly as shown from the periphery 42 (or inwardly in other embodiments), but such radial extension is not required. In some embodiments, the portion of the membrane 40 attached to the lid 38 can extend radially outwardly from the periphery to, and over, the rim 19 such that part of the membrane 40 is sandwiched between the lid 38 and the rim 19.

In this illustrative embodiment, first chamber contains a first beverage medium, which is a dry beverage medium. Preferably the first beverage medium is sealed by the membrane, lid and container during storage to prevent spoilage of the first beverage medium, and as such, the membrane prevents the fluid stored in the second chamber from coming in contact with the first beverage medium and provides a barrier to moisture and/or gasses such as oxygen from entering the first chamber.

In order to form a beverage using the cartridge and its ingredients, it is preferable to allow the contents of the first and second chamber to mix either just prior to or while forming a beverage using a beverage forming apparatus.

In this illustrative embodiment, the membrane 40 includes a valve 44, septum or other element that opens to permit a beverage to exit the first chamber when liquid is introduced into the first chamber 14*a*, but otherwise remains closed (e.g., to protect the first beverage medium from external conditions such as oxygen, moisture, the fluid 25 in the second chamber 14*b* or others). It should be understood that one or more such valves can be included to selectively join the first chamber and second chamber. It should also be understood that the location of the valve 44 is not limited to the bottom-most portion of the membrane, as the valve can be disposed at other portions of the membrane to direct the flow of liquids through the membrane.

Figure 3:
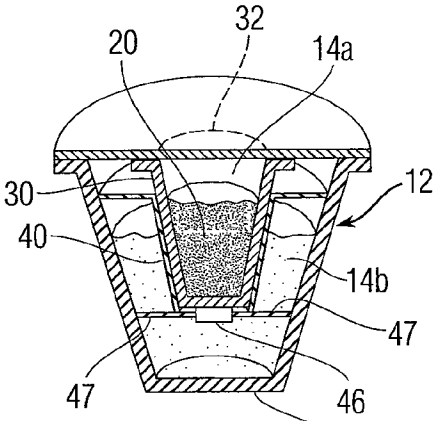
FIG. 3 shows an exploded view of another illustrative embodiment of a cartridge in accordance with an aspect of the invention.

Alternatively, as depicted in FIG. 3, the membrane can be completely fluid-non-permeable and can include a frangible joint 46, instead of a valve. The frangible joint is configured to be broken when stress above a prescribed threshold is applied to the frangible joint. Breaking the frangible joint creates a void in the otherwise fluid-non-permeable membrane, thereby joining the first and second chambers and allowing the fluid contained within the second chamber to come in contact with the first beverage medium in the first chamber. In one possible implementation, the frangible joint can be broken by the user by squeezing the cartridge just prior to inserting the cartridge into the beverage forming apparatus. Alternatively, the frangible joint can be broken by the introduction of a pressurized liquid into the first chamber. In addition, a plurality of beams 47 can be attached to the frangible joint and the container 12. The beams allow the transfer of stress from the sidewall 17 of the container 12 to the joint. In accordance with an aspect of the embodiment, the user can squeeze the container 12 where the beams 47 are joined to the sidewall and thereby place stress above a prescribed threshold on the frangible joint causing the frangible joint to break in a controlled, deliberate manner and create a void in the membrane allowing fluid to pass through the membrane.

In accordance with an aspect of the invention, the filter 30 is disposed within the first chamber 14*a* and can be attached to the lid 38 at a periphery 32 that is spaced inwardly and away from the rim 19. In addition, the filter 30 can extend from the periphery 32 at least partially into the interior space 14. It should be understood that alternatively, the filter can be attached to the container 12 or freely disposed within the first chamber 14*a* unattached to the container or the lid. As mentioned above, the filter 30 can be arranged in the first chamber 14*a* of the interior space 14 so that liquid introduced into the first chamber 14*a* of the interior space (e.g., that interacts with beverage medium 20) flows through the filter 30, through the valve or frangible joint of the membrane 40 and toward the second chamber 14*b* of the interior space 14 before exiting the container 12. The filter 30 can function to remove materials over a certain size from a liquid, e.g., can remove coffee grounds from liquid in the first chamber 14*a*, allowing a coffee beverage to pass through the filter 30 to the second chamber 14*b*. For example, the filter can include a piece of filter paper that is arranged to allow a liquid and dissolved and/or suspended materials of a certain size to pass, yet prevent relatively large particles from flowing through the filter. Of course, the filter 30 can have multiple stages, e.g., a coarse filter portion that filters out relatively large particles, followed by a fine filter portion that filters relatively smaller particles, and so on. In addition, the filter 30 can include one or more portions that function to filter liquid passing through the filter 30, as well as portions that are impermeable or otherwise restrict flow. Thus, the filter 30 can include two or more separate components, if desired. For example, the filter 30 can include a rigid, fluid-impermeable plastic sleeve that is attached to the lid 38 at the periphery 32. At a location away from the lid 38, a porous filter paper can be attached to the sleeve. Thus, not all portions of the filter need be permeable to liquids. The filter 30 can also have areas with different permeability, e.g., to help direct flow toward one or more areas of the filter 30. For example, regions of the filter 30 near the lid 38 in FIG. 1 can have a relatively lower permeability as compared to regions further away from the lid 38. This can help encourage flow through the beverage medium 20 toward lower regions of the filter 30, potentially improving the dissolution of materials in the medium 20 into the liquid.

In this illustrative embodiment, the filter 30 can have a substantially frustoconical shape with fluted or pleated sidewalls and a generally flat bottom 31, as shown. However, the filter 30 can have any suitable shape, such as a cylindrical shape, a square cup shape, a domed shape, a flat sheet, or other. The filter 30 can be the attached to the lid 38 in any suitable way, such as by an adhesive, thermal welding, ultrasonic welding, chemical bonding, crimping or other mechanical bonding, etc. As will be understood, the shape of the periphery 32 can depend on the shape of the filter, at least at an upper end of the filter 30. In this embodiment, the periphery 32 has a circular shape, but oval, rectangular, triangular, irregular, and other shapes are possible. In this illustrative embodiment, the filter 30 can include a permeable filter paper made of a combination of polypropylene and cellulose materials and can be attached to the lid 38 at an upper portion of the filter 30 by thermal welding. As can be seen in FIGS. 1-3, the upper portion of the filter 30 that is attached to the lid 38 can have an annular, or washer-like shape that extends radially outwardly as shown from the periphery 32 (or inwardly in other embodiments), but such radial extension is not required. In some embodiments, the portion of the filter attached to the lid 38 can extend radially outwardly from the periphery to, and over, the rim 19 such that part of the filter 30 is sandwiched between the lid 38 and the rim 19.

When using the cartridge 10 to form a beverage, the lid 38 and/or the container 12 can be pierced to introduce liquid into the cartridge and receive beverage from the cartridge. (As used herein, "beverage" refers to a liquid substance intended for drinking that is formed when a liquid interacts with the first beverage medium contained in the first chamber 14*a* and the fluid contained in the second chamber 14*b*. Thus, beverage refers to a liquid that is ready for consumption, e.g., is dispensed into a cup and ready for drinking, as well as a liquid that will undergo other processes or treatments, such as filtering or the addition of flavorings, creamer, sweeteners, another beverage, etc., before being consumed.) To introduce liquid into the cartridge, for example, a portion of the lid 38 can be pierced by an inlet piercing element 50 (e.g., a needle) so that water or other liquid can be injected into the cartridge 10. Other inlet piercing arrangements are possible, such as multiple needles, a shower head, a non-hollow needle, a cone, a pyramid, a knife, a blade, etc. A beverage machine that uses the cartridge can include multiple piercing elements of the same type or of different types, as the invention is not limited in this respect. In another arrangement, a beverage machine can include a piercing element (such as a spike) that forms an opening and thereafter a second inlet element (such as a tube) can pass through the formed hole to introduce liquid into (or conduct liquid out of) the container. In other embodiments, the lid 38 can be pierced, or otherwise effectively opened for flow, by introducing pressure at an exterior of the lid 38. For example, a water inlet can be pressed and sealed to the lid 38 exterior and water pressure introduced at the site. The water pressure can cause the lid 38 to be pierced or otherwise opened to allow flow into the cartridge 10. In another arrangement, the lid 38 can include a valve, conduit or other structure that opens when exposed to a suitable pressure and/or when mated with a water inlet tube or other structure.

As mentioned above, the membrane can selectively open, by way of a valve, or frangible joint that permits a beverage to flow from the first chamber 14*a* into the second chamber 14*b* when pressurized liquid is introduced into the first chamber 14*a*, but otherwise remains closed.

The cartridge 10 can also be penetrated by an outlet piercing element 52 (e.g., a needle) at a bottom 16 of the container 12. As with the inlet piercing arrangement, the outlet piercing arrangement can be varied in any suitable way. Thus, the outlet piercing element can include one or more hollow or solid needles, knives, blades, tubes, and so on. Alternately, the cartridge 10 can include a valve, septum or other element that opens to permit beverage to exit when liquid is introduced into the cartridge, but otherwise remains closed (e.g., to protect the beverage medium or fluid from external conditions such as oxygen, moisture or others). In such a case, no piercing element for forming the outlet opening is necessarily required although can be used, e.g., to allow the valve or other element to open. Also, in this illustrative embodiment the piercing element remains in place to receive beverage as it exits the opening formed in the container 12. However, in other embodiments, the piercing element can withdraw after forming an opening, allowing beverage to exit the opening and be received without the piercing element being extended into the cartridge 10.

Although the embodiments described above include a beverage medium 20 only in the first chamber 14*a*, those embodiments can include more than one beverage medium in the first chamber 14*a*. For example, a cartridge can include roast and ground coffee in the first chamber and a creamer and sweetener in the same chamber, enabling the cartridge to form a cappuccino- or latte-like beverage. In another embodiment, the first chamber 14*a* can include coffee grounds and hot chocolate material, allowing the cartridge to form a mocha-type beverage. Other combinations will occur to those of skill in the art. In some embodiments, another filter can be provided, e.g., to separate multiple dry beverage media in the first chamber. Similarly another filter can also be provided to separate beverage media from the valve or frangible joint of the membrane. In addition, another filter can be provided, e.g., to separate the beverage media from a fluid inlet or outlet.

Figure 4:
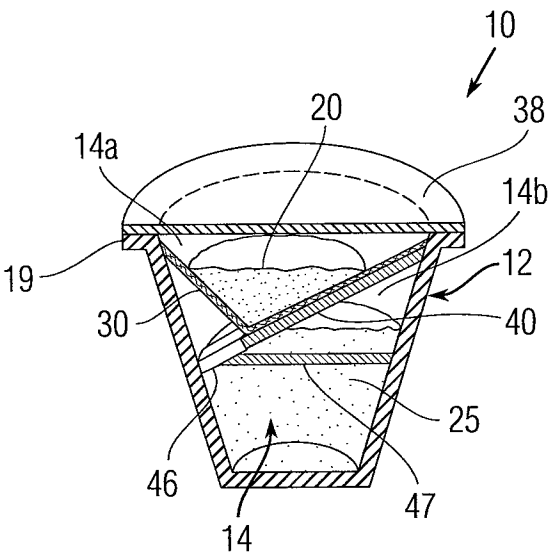
FIG. 4 shows an exploded view of yet another illustrative embodiment of a cartridge in accordance with an aspect of the invention.

Aspects of the invention can be implemented in cartridges having different shapes, sizes and/or configurations. For example, FIG. 4 shows an illustrative embodiment of a cartridge 10 that incorporates aspects of the invention. The cartridge includes a rim 19 (e.g., including an annular shaped element made of a plastic material) attached to a container 12. Attached to a top surface of the rim 19 is a lid 38. A filter 30, made of a filter paper is attached to the container 12 and extending into the interior space 14. A dry first beverage medium 20 can be contained inside the filter 30. A membrane 40 can also be disposed within the interior space 14 and connected to the interior wall of the container 12 thereby defining a first chamber 14*a* and second chamber 14*b*. The membrane can include a frangible joint 46 and a beam 47. A liquid 25 can be disposed within the second chamber 14*b*.

Figure 5:
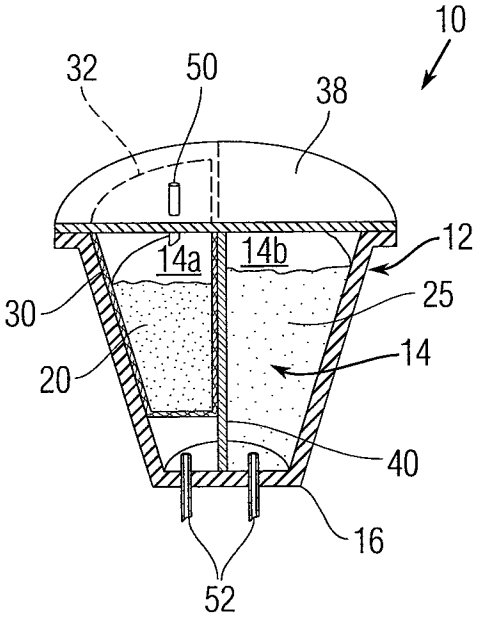
FIG. 5 shows an exploded view of yet another illustrative embodiment of a cartridge in accordance with an aspect of the invention.

FIG. 5 shows another illustrative embodiment of a cartridge 10 that incorporates aspects of the invention. In this embodiment, the cartridge 10 includes a lid 38 (e.g., like that described above including a sheet of foil/polymer laminate). The cartridge includes a fluid-non-permeable membrane 40 disposed within the interior 14 and is oriented longitudinally along the axis of the cartridge and attaches to the lid 38 and the container 12 dividing the interior in two and defining a first chamber 14*a* and a second chamber 14*b*. In addition a filter 30 is attached to the lid at a periphery 32 and extends into the first chamber. The filter contains a first beverage medium 20 and the second chamber contains a fluid ingredient.

When using the cartridge 10, as depicted in FIG. 5, to form a beverage, the lid 38 and/or the container 12 can be pierced to introduce pressurized liquid into the cartridge and receive a beverage from the cartridge. To introduce liquid into the cartridge, for example, a portion of the lid 38 within the periphery 32 can be pierced by an inlet piercing element 50 (e.g., a needle) so that water or other liquid can be injected into the first chamber 14*a* of the cartridge that contains the dry first beverage medium to mix with the first beverage medium and pass through the filter. The cartridge 10 can be penetrated by a plurality of outlet piercing elements 52 (e.g., a needle) at a bottom 16 of the container 12. One outlet piercing element can pierce the first chamber and a second outlet piercing element can pierce the second chamber. Accordingly, liquid introduced into the first chamber that has mixed with the first beverage medium and has passed through the filter can exit the first chamber, and in addition, the fluid ingredient can also be drained from the second chamber to form the beverage. Alternatively, it should be understood that a single outlet piercing element can be used to pierce the first and second chambers and/or the membrane and selectively join the first and second chambers such that their contents can combine to form a beverage.

Figure 6:
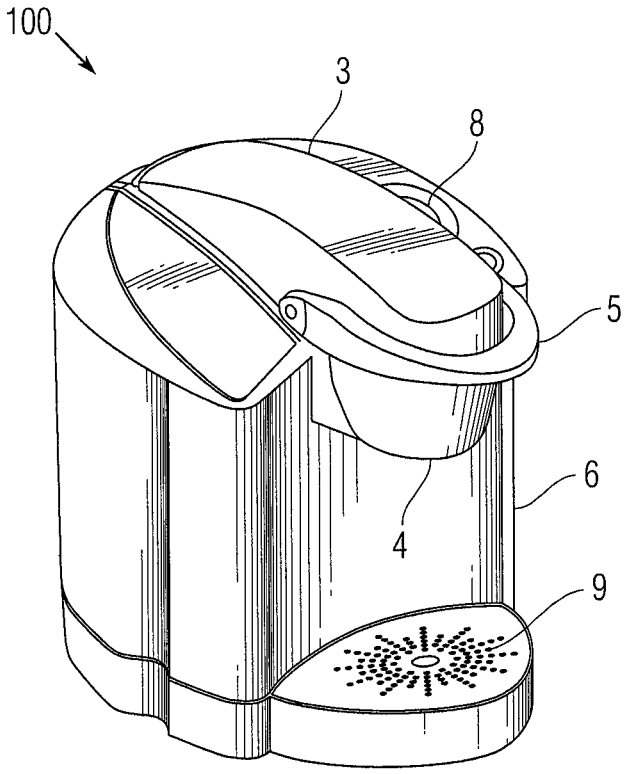
FIG. 6 is a perspective view of a beverage machine usable in accordance with aspects of the invention.

Cartridges in accordance with aspects of the invention can be used with any suitable beverage machine. For example, FIG. 6 shows a perspective view of a beverage forming apparatus 100 that can be used to form any suitable beverage, such as tea, coffee, other infusion-type beverages, beverages formed from a liquid or powdered concentrate, hot or cold drinks, etc. In this illustrative embodiment, the apparatus 100 includes an outer frame or housing 6 with a user interface 8 that the user can operate to control various features of the apparatus 100. A beverage cartridge 10 can be provided to the apparatus 100 and used to form a beverage that is deposited into a cup or other suitable receptacle that is placed on a drip tray 9 or other support, if any. The cartridge 10 can be manually or automatically placed in a cartridge receiving portion defined by first and second portions 3 and 4 of the beverage forming apparatus 100. For example, by lifting a handle 5, the user can move the first and second portions 3 and 4 to an open position to expose a suitably shaped area in which the cartridge 10 can be placed. After placement of the cartridge 10, a handle 5 or other actuator can be moved in a manual or automatic fashion so as to move the first and second portions 3 and 4 to a closed position (shown in FIG. 10), thereby at least partially enclosing the cartridge 10 within a brew chamber. It should be understood, however, that the cartridge 10 can be received in any suitable way by the apparatus 100, as the way in which the apparatus 100 receives or otherwise uses the cartridge 10 is not critical to aspects of the invention.

Once the cartridge 10 is received, the beverage forming apparatus 100 can use the cartridge 10 to form a beverage. For example, one or more inlet needles associated with the first or second portion 3, 4 can pierce the cartridge 10 so as to inject heated water or other liquid into the cartridge 10. The first or second portion 3, 4 can also include one or more outlet needles or other elements 52 to puncture or pierce the cartridge 10 (as needed) at an outlet side to permit the formed beverage to exit the cartridge 10.

Figure 7:
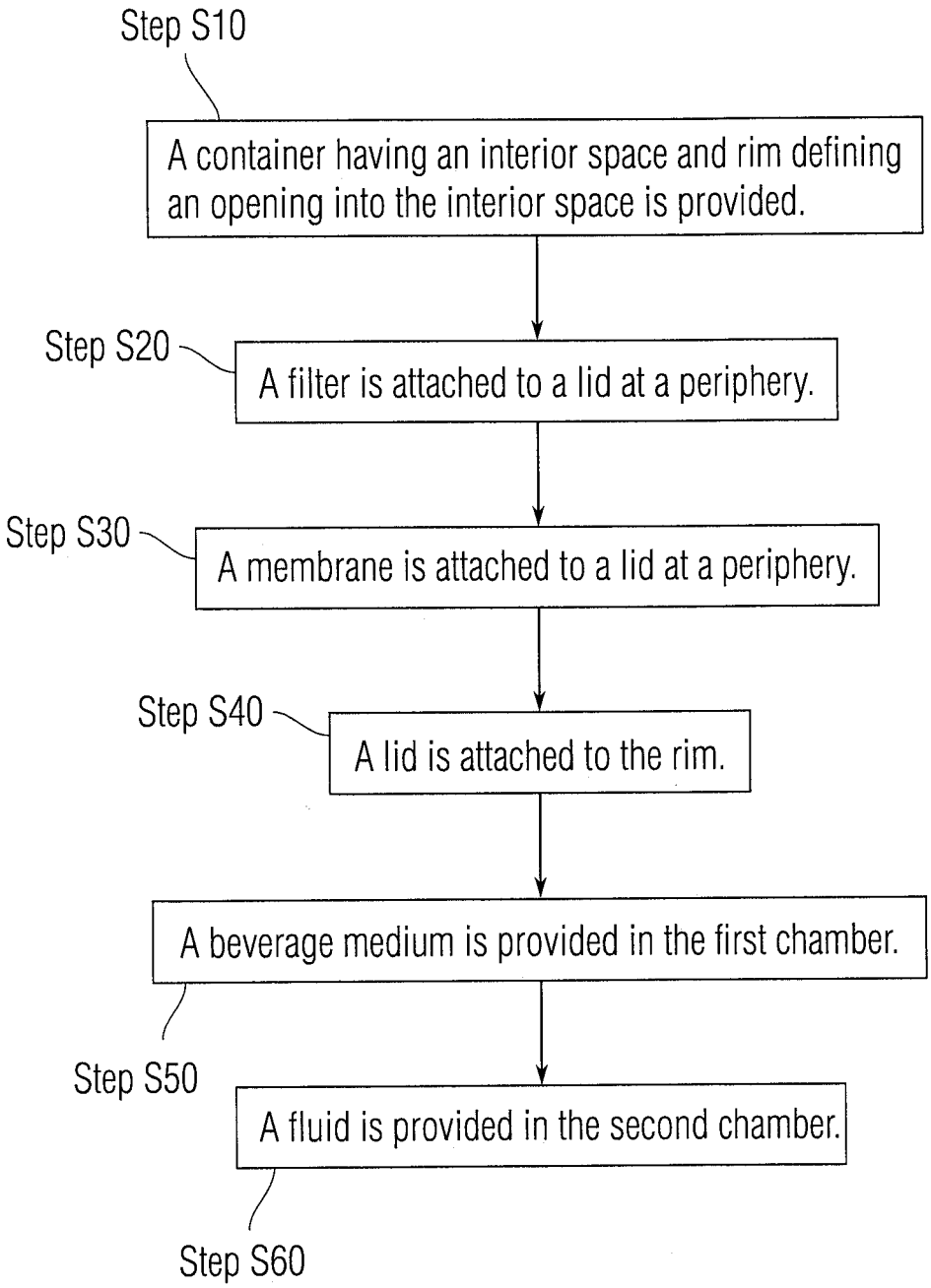
FIG. 7 shows steps in a method of manufacturing a cartridge in accordance with aspects of the invention.

Another aspect of the invention includes a method of manufacturing a cartridge. Steps of one such illustrative method are shown in FIG. 7. (The steps in FIG. 7 are shown connected in dashed line so as to indicate that the steps of the method can be performed different orders other than that shown, as described in more detail below.)

In step S10, a container having an interior space and a rim defining an opening into the interior space is provided. The container can be made of any suitable material, such as plastic, paper, metal and combinations of materials. Generally, the container is impermeable to liquid so that beverage created in the cartridge can be removed in a controlled way, but can have permeable portions. Also, the container can have any suitable shape, such as frustoconical, spherical, cylindrical, a rectangular box, and so on. Moreover, the container need not have a defined shape, and instead can be made of a flexible material.

In step S20, a filter is attached to a lid at a periphery. The periphery is a closed boundary line where the filter is attached to the lid and extends away from the lid (e.g., into the interior space of the container). The filter can include any suitable material, such as filter paper, permeable or impermeable plastic material, a sponge like material, and so on. Also, the filter can include impermeable as well as permeable elements. For example, an impermeable plastic element can be attached to the lid and provide structural support for a filter paper or other material that is attached to the plastic element. The filter can have any suitable shape, size and/or permeability. For example, the filter can have areas of different permeability so as to prevent or restrict flow through some areas of the filter while facilitating flow through other, more permeable areas. Alternatively, or in addition, the filter can be attached to the container. As a further alternative, the filter can be freely placed in the first chamber such that it is not attached to the lid or container.

In step S30, a membrane is attached to the lid at a periphery. The periphery is a closed boundary line where the membrane is attached to the lid and extends away from the lid (e.g., into an interior space of the container and defining a first chamber and a second chamber). The membrane can include any suitable fluid non-permeable material including polypropylene and cellulose material, a polymer laminate, e.g., formed from a sheet including a layer of polystyrene or polypropylene and a layer of EVOH and/or other barrier material. Also, the membrane can include selectively fluid-permeable elements such as a one way valve or a frangible joint. The one way valve opens to permit a beverage to exit when liquid is introduced into the first chamber, but otherwise remains closed (e.g., to protect the contents of the first chamber from external conditions such as oxygen, moisture, or a fluid disposed in the second chamber). A frangible joint can be selectively broken to combine the contents of the first and second chambers. Alternatively, or in addition, the membrane can be attached to the container.

In step S40, the lid is attached to the rim (e.g., to at least partially to close the opening). The lid can be attached to the rim in any suitable way, such as thermal or acoustic welding, adhesive, chemical bonding, mechanical bonding, and so on. In some embodiments, the rim can include a groove or other feature that assists in removal of the lid from the rim. The lid can be made of any suitable material, such as a foil, a foil and polymer laminate, a polymer material, and so on, and can be permeable or impermeable. However, the lid generally is made of a fluid impermeable material so as to aid in controlling the flow of liquid in the cartridge.

In step S50, a beverage medium is provided in the interior space of the cartridge, e.g., into a first chamber that is separated from a second chamber by the membrane. The beverage medium can be contained by the filter and can be arranged to interact with liquid introduced into the container to form a beverage, and can include roast and ground coffee, leaf tea, instant coffee or tea, hot chocolate mix, a powdered drink mix, dried fruit materials, sweetener, creamer, thickener, and/or any other suitable material for forming a beverage.

In step S60, a pressurized fluid is provided in the interior space of the cartridge, e.g., into the second chamber that is separated from the first chamber by the membrane. The fluid can be arranged to interact with liquid introduced in to the container to form a beverage, and can include alcoholic ingredients, dairy products, liquid flavorings and/or any other fluid ingredients suitable for forming a beverage.

It should be understood that steps in the method outlined in FIG. 7 can be performed in any suitable order. For example, in one embodiment, the first beverage medium can be provided in a space defined by the membrane and filter before the membrane and filter are attached to the lid or container. In another embodiment, the first beverage medium can be provided into a space defined by the membrane and filter after the membrane and filter are attached to the lid or container.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A cartridge for use in forming a beverage in a beverage machine that provides a pressurized liquid, the cartridge comprising:

a container having an exterior surface and an interior space;

a rim attached to the container and defining an opening to the interior space;

a lid attached to the rim and closing the opening of the container, wherein the lid is pierceable by the beverage machine to accommodate an inflow of the pressurized liquid into the interior space to form the beverage;

a fluid-non-permeable membrane disposed within the interior space and defining a first chamber and a second chamber within the interior space, wherein the membrane is configured to selectively isolate the first and second chamber;

a fluid stored within the second chamber, wherein the fluid is arranged to interact with the pressurized liquid introduced into the container to form the beverage; and a filter disposed within the first chamber, wherein the filter is arranged to contain a dry first beverage medium arranged to interact with the pressurized liquid introduced into the container to form the beverage, wherein the filter is permeable and is disposed between the first beverage medium and the membrane.

2. The cartridge of claim 1, wherein the membrane includes a one-way valve arranged to allow the flow of the pressurized liquid from the first chamber into the second chamber and to prevent flow from the second chamber into the first chamber.

3. The cartridge of claim 1, wherein the membrane is a fluid-non-permeable and includes a frangible joint disposed between the first chamber and the second chamber and is configured to join the first and second chambers in response to breakage of the frangible joint, and wherein the filter that is disposed between the first beverage medium and the membrane completely separates the dry first beverage medium from the membrane.

4. The cartridge of claim 3, wherein the membrane is coupled to the container so that a stress above a prescribed threshold applied to the exterior surface of the container causes the breakage of the frangible joint.

5. The cartridge of claim 3, further comprising structural beams coupling the frangible joint to the exterior surface of the container.

6. The cartridge of claim 1, wherein the membrane has at least a portion that is adjacent to the filter.

7. The cartridge of claim 1, further comprising a third chamber between the filter and the membrane.

8. The cartridge of claim 1, wherein the filter is attached to the lid.

9. The cartridge of claim 1, wherein the filter is attached to the container.

10. The cartridge of claim 1, wherein the membrane is attached to the lid.

11. The cartridge of claim 10, wherein the membrane includes a one-way valve arranged to allow the flow of the pressurized liquid from the first chamber into the second chamber and to prevent flow from the second chamber into the first chamber.

12. The cartridge of claim 10, wherein the membrane is a fluid-non-permeable and includes a frangible joint disposed between the first chamber and the second chamber and is configured to join the first and second chambers in response to breakage of the frangible joint.

13. The cartridge of claim 12, wherein the membrane is coupled to the container so that a stress above a prescribed threshold applied to the exterior surface of the container causes the breakage of the frangible joint.

14. The cartridge of claim 12, further comprising structural beams coupling the frangible joint to the exterior surface of the container.

15. The cartridge of claim 1, wherein the membrane is attached to the container.

16. The cartridge of claim 15, wherein the membrane includes a one-way valve arranged to allow the flow of the pressurized liquid from the first chamber into the second chamber and to prevent flow from the second chamber into the first chamber.

17. The cartridge of claim 15, wherein the membrane is a fluid-non-permeable and includes a frangible joint disposed between the first chamber and the second chamber and is configured to join the first and second chambers in response to breakage of the frangible joint.

18. The cartridge of claim 17, wherein the membrane is coupled to the container so that a stress above a prescribed threshold applied to the exterior surface of the container causes the breakage of the frangible joint.

19. The cartridge of claim 17, further comprising structural beams coupling the frangible joint to the exterior surface of the container.

20. A cartridge for use in forming a beverage in a beverage machine that provides a pressurized liquid, the cartridge comprising:

a container having an exterior surface and an interior space;

a rim attached to the container and defining an opening to the interior space;

a lid attached to the rim and closing the opening of the container;

a fluid-non-permeable membrane disposed within the interior space and defining a first chamber and a second chamber within the interior space, wherein the membrane is configured to selectively isolate the first and second chamber;

a fluid stored within the second chamber; and a filter disposed within the first chamber, wherein the filter is arranged to contain a dry first beverage medium, wherein the filter is permeable and is disposed between the first beverage medium and the membrane.

* * * * *